US006558617B2

(12) United States Patent
Miwa

(10) Patent No.: US 6,558,617 B2
(45) Date of Patent: May 6, 2003

(54) COPPER ALLOY FOR USE IN ELECTRIC AND ELECTRONIC PARTS

(75) Inventor: Yosuke Miwa, Shimonoseki (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/860,596

(22) Filed: May 21, 2001

(65) Prior Publication Data

US 2002/0012603 A1 Jan. 31, 2002

(30) Foreign Application Priority Data

May 25, 2000 (JP) ..... 2000-155351

(51) Int. Cl.[7] ..... C22C 9/04
(52) U.S. Cl. ..... 420/481; 148/434
(58) Field of Search ..... 420/477, 481, 420/485, 478, 479; 148/434

(56) References Cited

U.S. PATENT DOCUMENTS 6,132,529 A * 10/2000 Hatakeyama et al. ..... 148/435

FOREIGN PATENT DOCUMENTS

| | | |
|---|---|---|
| JP | 9-104956 | 4/1997 |
| JP | 10-298679 | 11/1998 |
| JP | 10-298680 | 11/1998 |
| JP | 11-199952 | 7/1999 |
| JP | 2000-54043 | 2/2000 |

* cited by examiner

*Primary Examiner*—Sikyin Ip
(74) *Attorney, Agent, or Firm*—Oblon, Spivak, McClelland, Maier & Neustadt, P.C.

(57) ABSTRACT

A copper alloy of high strength and high electroconductivity which is excellent in characteristics such as strength, electroconductivity and bending formability required as copper alloys for use in electric and electronic parts such as lead frames, terminals and connectors, as well as excellent in the characteristics such as softening resistance, shearing formability. Ag plating property and soldering wettability, the copper alloy comprising:

Ni: 0.1 to 1.0% (means mass % here and hereinafter), Fe: 0.01 to 0.3%, P: 0.03 to 0.2%, Zn: 0.01 to 1.5%, Si: 0.01% or less; and Mg: 0.001% or less; in which the relation between the P content and the Si content satisfies the relation:

P content/Si content$\geqq$10, and the relation for the Ni content, the Fe content and the P content can satisfy following relations:

5$\leqq$(Ni content+Fe content)/P content$\leqq$7

4$\leqq$Ni content/Fe content$\leqq$9.

19 Claims, No Drawings

COPPER ALLOY FOR USE IN ELECTRIC AND ELECTRONIC PARTS

BACKGROUND OF THE INVENTION

1. Field of the Invention

This invention concerns a copper alloy for use in electric and electronic parts used, for example, in semiconductor lead frames, terminals, connectors and bus bars and, more in particular, it relates to a copper alloy available at a reduced cost and having a conductivity of 50% IACS or more while having high strength substantially comparable with that of 42 alloy, as well as having softening resistance, favorable shearing formability, bending formability, Ag plating property and soldering wettability.

2. Description of Related Art

As lead frames for use in semiconductors, ferreous materials represented by 42 alloys and cupreous materials such as Cu—Ni—Si series alloys, Cu—Sn series alloys, Cu—Cr series alloys, Cu—Fe—P series alloys have been used so far. The cupreous materials have higher conductivity compared with ferreous materials and, accordingly, have an advantageous feature of excellent heat dissipation. Further, since the recent trend of using Pd (palladium) for exterior plating of IC or LSI results in a problem of peeling due to aging deterioration of the plating in the ferreous materials, the cupreous materials has been used more and more. On the contrary, since the cupreous materials has low strength, various improvements have been made for enhancing the composition or in the manufacturing method for increasing strength. This was considered extremely important, particularly, in the past stage where LSI packages using lead frames represented by QFP (Quad Flat Package) in which the number of leads exceeds 200 pin were developed vigorously.

In recent years, area mounted type packages represented by BGA (Ball Grid Array) have been developed and most of LSIs exceeding 200 pin have now been replaced progressively with such packages. However, such area mounted type packages are not suitable in a situation where the heat generation amount of semiconductor chips is increasing along with increase in the degree of integration and operation speed of LSIs. Therefore, it is necessary to attach heat dissipating plates or heat spreaders for enhancing the heat dissipation which makes the packaging complicated.

As described above, a reasonable heat dissipation method is one of subjects in packages mounting chips of large heat generation amount and packages using the former lead frames have now been re-estimated. In the packages using the lead frames, most of heat is dissipated by way of paths the leads to the substrate.

In this case, high heat conductivity due to the material of the lead per se has an effect on the heat dissipation of the entire packaging. Since the heat conductivity is in a linear relationship with the electroconductivity, a material of high electroconductivity is demanded in other words. In this regard, the ferreous 42 alloy has an electroconductivity as low as 3% IACS but the cupreous materials have higher electroconductivity and are advantageous.

Accordingly, a cupreous material having not only general characteristic as the lead material but also strength comparable with that of 42 alloy is demanded. Thus, copper alloys such as Cu—Ni—Si series or Cu—Sn series alloys capable of providing high strength, or Cu—Cr series or Cu—Fe—P series alloys capable of providing high electroconductivity have been used.

As the method of overcoming such problems, copper alloys of high strength and high electroconductivity by improving Cu—Fe—P series alloys have been proposed, for example, in JP-A-Nos. 298679/1998, 298680/1998 and 199952/1999.

Since any of the alloys described above contains 0.5% or 0.3% or more of Fe and 0.1% or more of P, so-called internal oxidation tends to occur frequently upon heat treatment. The oxide layers extremely deteriorate the soldering wettability even when they are formed by such a slight thickness as can not be measured by instrumental analysis. In addition, since Mg is incorporated by 0.05% or more in JP-A-No. 199952/1999, it may be a worry of abnormal precipitation in Ag plating (hereinafter referred to as Ag plating protrusion).

A copper alloy as disclosed in JP-A-No. 54043/2000 has been proposed intending for high strength and high electroconductivity by incorporation of Ni, Fe and P. However, no consideration is made there on the softening resistance.

SUMMARY OF THE INVENTION

In view of the above, this invention intends to provide a copper alloy of high strength and high electroconductivity which is excellent in characteristics such as strength, electroconductivity and bending formability required as copper alloys for use in electric and electronic parts such as lead frames, terminals and connectors, as well as excellent in the characteristics such as softening resistance, shearing formability, plating property and soldering wettability by overcoming the foregoing problems.

A copper alloy for use in electric and electronic parts according to this invention comprises:

Ni: 0.1 to 1.0 mass %

Fe: 0.01 to 0.3 mass %

P: 0.03 to 0.2 mass %

Zn: 0.01 to 1.5 mass %

Si: 0.01 mass % or less and

Mg: 0.001 mass % or less, wherein the relation for the Ni content, Fe content, P content and Si content satisfies the following relations simultaneously:

P content/Si content $\geqq 10$ $5 \leqq$ (Ni content+Fe content)/P content $\leqq 7$ $4 \leqq$ Ni content/Fe content $\leqq 9$.

In the copper alloy described above, it is preferred to precipitate precipitates of Ni/Fe/P of (0.5 to 5)/(0.1 to 2)/1 at the mass ratio.

The copper alloy may comprises one or both of $\hat{1}$ one or more of Co, Cr and Mn by 0.005 to 0.05% in total and $\hat{2}$ one or more of Al, Sn, Zr, In, Ti, B, Ag and Be by 0.005 to 0.05% in total. Copper alloys containing the elements described above by less than the lower limit as inevitable impurity can of course be included in this invention.

It is preferred to restrict O: 100 ppm or less and H: 5 ppm or less among in the inevitable impurities.

DETAILED DESCRIPTION OF THE PREFERRED EMBODIMENTS

The reasons for restricting the ingredients and conditions as described above are to be explained.

[Ni Content]

Ni precipitates an intermetallic compound together with P to be described later to enhance the strength of a copper alloy. Since the NiP compound is an not intermetallic compound stable at high temperature, it is poor in the softening resistance. However, the softening resistance is outstandingly improved while keeping the strength as it is by the incorporation of Fe to the Ni—P precipitates to form a ternary intermetallic compound. In addition, the shearing formability is also improved.

When the Ni content is less than 0.1%, since the precipitation amount of the intermetallic compound is small, desired high strength and shearing formability can not be obtained. On the other hand, when the Ni content exceeds 1.0%, a great amount of coarse precipitates of the Ni—P compound is formed during casting to extremely deteriorate the hot formability. The Ni—P compound deteriorates the hot formability particularly in a temperature region of 700 to 900° C. This temperature range is most required practically since hot working at high working rate is possible with a low energy because of the low transformation resistance. Further, even when the hot fabrication or working is possible below this temperature region, the remaining NiP compound scarcely contributes to the improvement of the strength and deteriorates the bending formability of products.

Accordingly, the Ni content is defined as 0.1 to 1.0%. A more preferred range is from 0.3 to 0.7%.

[Fe Content]

Fe causes both high strength and high softening resistance for the copper alloy by forming an intermetallic compound with Ni and P as described above. When the Fe content is less than 0.01%, the Ni—P compound can not be transformed into an Ni—Fe—P ternary compound and the copper alloy can not effectively satisfy the demand for high softening resistance required for lead frames, terminals and connectors. For coping with the recent requirement for reduction of thickness and size and improvement for the mounting density in various kinds of electric and electronic equipments, a technique of decreasing the residual stress generated by shearing upon press punching has been developed and used generally. This is a technique of applying a heat treatment once for a short period of time from several seconds to several minutes upon lead punching while bundling the leads as they are without cutting off the top ends thereof thereby relieving the residual stress caused upon punching the lateral sides of the leads, subsequently cutting off the top ends of the leads to ensure flatness. When the softening resistance of the copper alloy is low, the material is softened during the heat treatment in the short period of time to cause deformation of frames upon cutting off the lead top ends. Even when the frame could be worked, disadvantageous such as frame deformation occurs during subsequent assembling of LSI.

In addition, Fe also has an effect of improving the hot formability in a copper alloy to which Ni and P are added. As described above, Ni tends to form coarse precipitates of Ni—P compound upon casting and the precipitates which extremely deteriorate the hot formability in a range of 700 to 900° C. In this case, Fe, being transformed into the Fe—P compound, provides an effect of suppressing the generation amount of precipitates and improving the hot formability of the Ni—P compound.

On the other hand, when the Fe content exceeds 0.3%, Fe—P compound precipitates predominantly to the precipitation of Ni—Fe—P compound. As a result, not only the high strength and high softening resistance obtained by the precipitation of the Ni—Fe—P compound can not be obtained but also the shearing formability (press punching performance) is not improved.

Further, Fe is most likely to form internal oxide layers upon annealing next to element such as Mg or Si. When a heat treatment is applied in a low oxygen atmosphere in order to suppress external oxidation of Cu, growth of the internal oxide layer is more promoted than that in atmospheric air. Further, since it proceeds from the surface of the matrix material into the inside of the bulk, the oxide layer once grown can not but be removed by etching the surface of the matrix using, for example, a mixed solution of sulfuric acid and hydrogen peroxide. Thus, the growth of the oxide layer deteriorates pickling property. Then, when the oxide layer remains even little, it gives undesired effect on the surface property such as defective gloss in Ag plating or deterioration of the soldering wettability. As described above, while short time annealing is adopted generally with an aim of removing residual stress formed upon lead punching as described above, the heat treatment is applied by using a tunnel or the like and the atmosphere therein is a low oxygen atmosphere that promotes internal oxidation. The internal oxidation tends to be caused remarkably when Fe exceeds 0.3%.

Accordingly, the Fe content is defined as 0.01 to 0.3%. A more preferred range is from 0.05 to 0.2%.

[P Content]

P forms an intermetallic compound with Ni and Fe, which precipitates in the Cu matrix phase to improve the strength and the softening resistance of the copper alloy. Further, it forms precipitates different from Ni—Fe—P precipitates together with Co, Cr, Mn to be described later to give an effect of improving the shearing formability. However, when the P content is less than 0.03%, the precipitation amount of the Ni—Fe—P precipitates is not sufficient to obtain desired strength and softening resistance. Further, when the P content exceeds 0.2%, a great amount of precipitates of the Ni—P compound described above is formed to extremely deteriorate the hot formability.

Accordingly, the P content is defined as 0.03 to 0.2%. A more preferred range is from 0.06 to 0.15%.

[Zn Content]

Zn has an effect of reducing the wear of a pressing mold and preventing migration and improves the heat resistant peeling property of solder and Sn plating. When the Zn content is less than 0.01%, no desired effect can be obtained. On the other hand, when the content exceeds 1.5%, the electroconductivity is lowered and the soldering wettability is also deteriorated.

Accordingly, the Zn content is defined as 0.01 to 1.5%. A more preferred range is 0.05 to 0.5% and a further preferred range is 0.05 to 0.2%.

[Si Content]

Si is chemically bonded with Ni to form an intermetallic compound $Ni_2Si$, which precipitates in the alloy. However, no sufficient precipitation can be formed unless the temperature is higher than the temperature region where the Ni—Fe—P compound described above is precipitated. Accordingly, it is difficult that Si forms the Ni—Si compound under the heat treatment condition optimized to the precipitation of the Ni—Fe—P compound. As a result, since most of Si is solid-solubilized in the matrix material of the alloy, not only the electroconductivity is lowered, but also the heat resistant peeling property of soldering and Sn plating is deteriorated when the relation with the P content to be described later is not satisfied. Further, Si is an element tending to cause internal oxidation like Fe described above and solid solubilized Si greatly promotes internal oxidation and also deteriorates the bending formability. Such effects become conspicuous when the Si content exceeds 0.01%.

Accordingly, the Si content is restricted as 0.01% or less (including 0%). A more preferred range is 0.005% or less.

[Mg Content]

Mg forms a compound with S inevitably intruding into the matrix material to form an Mg—S compound thereby deteriorating the Ag plating property. When the compound is present, abnormal precipitation occurs upon Ag plating to cause Ag protrusion. When an Si chip is bonded while leaving the protrusion as formed, localized stress is applied to the protrusion to cause chip cracking. Further, Mg tends to cause internal oxidation like Fe or Si and also to deteriorate the bending formability. These effects become conspicuous when the Mg content exceeds 0.001%.

Accordingly, the Mg content is restricted to 0.001% or less. A more preferred range is 0.0005% or less.

[P Content/Si Content]

The relation between the P content and the Si content concerns formation of the intermetallic compound with Ni. The heat resistant peeling property of soldering and Sn plating is deteriorated as described above, depending on the relation with the P content. When the value for the P content/Si content is less than 10, since the amount of solid-solubilized Si increases, the heat resistant peeling property of the solder and the Sn plating is undesirably deteriorated remarkably.

Accordingly, the relation between the P content and the Si content is defined as: P content/Si content≧10. A more preferred range is: P content/Si content≧15.

[(Ni Content+Fe Content)/P Content]

[Ni Content/Fe Content]

When the Ni content, the Fe content and the P content simultaneously satisfy the relations: 5≦(Ni content+Fe content)/P content≦7 and 4≦Ni content/Fe content≦9, the strength and the softening resistance are improved remarkably. That is, when the two relations are satisfied, the Ni—Fe—P compound is precipitated within a more preferred range of the compositional ratio to be described later. When the precipitates are precipitated finely and uniformly, the strength can be improved by precipitation hardening and since it has stability at high temperature, different from the Ni—P compound, softening resistance is excellent.

Accordingly, it is preferred that the Ni content, Fe content and P content satisfy the two relations described above. A more preferred range is: 5≦(Ni content+Fe content)/P content≦6, and 4≦Ni content/Fe content≦8.

[Compositional Ratio for Ni/Fe/P]

As described above, the composition of the precipitate changes depending on the relation for the Ni content, Fe content and P content and high strength. High softening resistance can be attained simultaneously when the compositional (mass) ratio of Ni/Fe/P is: (0.5 to 5)/(0.1 to 2)/1. Accordingly, it is preferred that the precipitates of the Ni/Fe/P compositional ratio within the range described above are precipitated. A more preferred range is: (2 to 5)/(0.5 to 1)/1.

[Co, Cr, Mn Content]

Co, Cr and Mn form a compound with P to precipitate in the copper alloy and improve the shearing formability. When the compound is dispersed in the copper alloy, metallurgical continuity with the matrix material is tended to be interrupted because the precipitating behavior is different from that of the Ni—Fe—P precipitate described above (relatively large precipitates are formed), thereby enabling to improve the sharing formability remarkability. This effect is shown remarkably when the total content of Co, Cr and Mn is 0.005 or more.

However, this compound tends to form not uniform precipitates compared with the Ni—Fe—P compound. Particularly, since it precipitates preferentially at the crystal grain boundary, micro structures tend to be grown not uniformly to deteriorate the bending formability. This phenomenon appears remarkably when the total content of Co, Cr and Mn exceeds 0.05%.

Accordingly, when they are added, the total content of Co, Cr and Mg is defined as 0.005 to 0.05%.

<Al, Sn, Zr, In, Ti, B, Ag, Be Content>

As described above, a technique of decreasing the residual stress formed by shearing upon press punching has been developed and adopted generally. In this technique, it is necessary that the material per se has high softening resistance so as not to be softened by annealing in the course of the punching process. The elements described above improve the strength by solid solubilization into the copper alloy and, further, provide more excellent softening resistance for the copper alloy in a state coexistent with the Ni—Fe—P precipitates.

For removing the residual stress formed by shearing upon press punching, it is necessary to heat the material so that dislocations in the material can be displaced easily. The residual stress is removed by the movement of the dislocations. However, when the dislocations are displaced, the dislocations cause pair extinction to lower the dislocations density. In other words, work-hardened material is softened by the movement of the dislocations. In this case, when the elements described above are solid solubilized, the atoms have high affinity with vacancies to bury the vacancy sites with the atoms. Therefore, the amount of vacancies in the alloy is decreased to suppress the upward movement of the dislocations, and the dislocations trapped in the Ni—Fe—P precipitate tend to move less easily. As a result, pair extinction of the dislocations are suppressed to increase the softening resistance of the copper alloy.

This effect is not sufficient when the total content of the elements described above is less than 0.005%, whereas the electroconductivity is lowered and the soldering wettability is deteriorated when it exceeds 0.05%. Accordingly, the content of the elements is defined as 0.005 to 0.05% as one or the total of two or more of them.

<O Content>

O tends to easily react with P. When O exceeds 100 ppm, the reacted P can no more form a compound with Co, Cr and Mn described above. As a result, this can not provide the effect of improving the shearing formability. In addition, the soldering wettability is also deteriorated.

Accordingly, the O content is 100 ppm or less, more preferably, 40 ppm or less and, further preferably, 20 ppm or less.

<H Content>

When O is contained by 100 ppm or more as described above, H is bonded with O into steams in the cooling process of casting when the H content exceeds 10 ppm, and the steams cause blow hole defects in cast ingots. As a result, internal defects referred to as overlapped surface or swelling is caused during heat treatment in the products.

Accordingly, the H content is 10 ppm or less, more preferably, 4 ppm or less and, further preferably, 2 ppm or less.

EXAMPLE

Examples 1 to 2 according to this invention are to be explained. In each of the examples, measurement for tensile strength, electroconductivity, softening resistance, shearing formability, bending formability, heat resistant solder peeling property, soldering wettability, Ag plating property and the thickness for the internal oxide, and identification for the precipitates were investigated by the following methods.

(Tensile Strength)

A test specimen according to JIS No. 5 in which the longitudinal direction of the test specimen was made in parallel with the rolling direction was prepared and measured.

(Electroconductivity)

A rectangular test piece was fabricated by milling and measurement was conducted by a double bridge type resistance measuring apparatus.

(Softening Resistance)

A thin plate specimen of 0.25 mm thickness and 30 mm×30 mm area was prepared and the Vickers hardness of the specimen in the not heated state was measured. Then, the specimen was held for one minute in a salt bath heated to a predetermined temperature. Then, the temperature is lowered to a room temperature by water cooling, and the oxide layer at the surface was removed and the Vickers hardness at this stage was measured. The measurement was conducted for several points of heat-retaining temperature and the heat-retaining temperature at which the Vickers hardness after heating was 0.9 times the value before heating was determined. This temperature was defined as an index for the softening resistance. That is, since the hardness returned no more to the initial hardness when the heating temperature was somewhat higher even when it was returned to the temperature after the heating, the softening resistance was evaluated in this regard. The softening resistance can be said favorable as the limit heating temperature from which the hardness can return to the vicinity of the initial hardness is higher.

(Shearing Formability)

Burrs were evaluated by punching leads of 0.3 mm width by a mechanical press and in view of the ratio of the height of the shearing cross section relative to the plate thickness (hereinafter referred to as a sheared surface ratio) and the height of burrs. The sheared surface ratio was observed for the punched out leads for the lateral surface by a scanning type electron microscope and the ratio of the height of the sheared surface relative to the plate thickness was measured. Further, the height of the burrs was observed by the scanning type electron microscope for the burred surface of the leads at n=10, and indicated as an average value for each of maximum burr height and expressed by five steps of levels. When the sheared surface ratio is large, an excessive pressure is applied to the punch upon punching operation to increase the abrasion of molds.

(Bending Formability)

Fabrication was conducted by the method according to JIS H3130 by using a W type bending jig having bending of radius equal with the plate thickness. The W bent portion after fabrication was visually observed and the formability was evaluated depending on the absence or presence of cracking.

(Heat Resistant Solder Peeling)

After coating weakly active flux on a rectangular test specimen and soldering the same in a soldering bath kept at 245±5° C. (Sn/Pb=60/40), it was heated in an oven at 150° C. for 1000 hours. The test specimen was bent back at 180° C. to observe whether the solder at the fabricated portion was peeled or not.

(Soldering Wettability)

A non-active flux was coated on a rectangular test specimen. The test specimen was dipped in a soldering bath (Sn/Pb=60/40) kept at 245±5° C. for five seconds and then it was pulled up to observe deposition state of solder to the test specimen. The repelling state was observed and classified into five stages.

(Ag Plating Property)

Cyanate Ag plating was applied to 1 $\mu$m thickness and the absence or presence of locally increasing thickness (protrusion) was observed by a streoscopic microscope.

(Measurement for the Thickness of Internal Oxide Layer)

Ionized particles emitted by sputtering from the surface of a specimen were mass analyzed by a secondary ion mass spectrometer (SIMS) to determine the profile of oxides in the direction of the depth. The depth at which the difference with the inside of the matrix was eliminated was defined as the thickness for the internal oxide layer.

(Identification for Precipitates)

Composition of precipitates was semi-quantitatively determined by an energy dispersion type X-ray analyzer (FDX) appended to a transmission electron microscope (TEM). Precipitates with n=3 per one specimen were observed and the compositional ratio was determined based on the average value as the mass ratio.

Example 1

Copper alloys of the chemical compositions shown in Table 1 were prepared by melting by an electric furnace in an atmospheric air into cast ingots of 50 mm thickness, 80 mm width and 200 mm length. Subsequently, after heating the cast ingots at 950° C. for 1 hour, they were hot rolled to 15 mm thickness and, immediately, quenched in water such that the cooling rate was 20° C./sec or higher. Subsequently, after scraping the surface of the hot rolled materials to remove the oxide layers, they were cold rolled to 1.0 mm. Successively, they were heated rapidly in a short period of time at 750° C.×1 minute and then applied with cold rolling at a working ratio of 40% and aging precipitation treatment at 450° C.×2 hours. Subsequently, cold rolling at the working ratio of 60% was applied to prepare test specimens each of 0.25 mm thickness and the test described above was conducted. In this case, the temperature elevation rate in the rapid short time heating was 5° C./sec, the cooling rate after the short time heating was 10° C./sec or higher and the temperature elevation rate upon aging precipitation heat treatment was 0.01° C./sec and both of the heat treatments were conducted in an atmosphere at an oxygen concentration of 500 to 2000 rpm in a combustion gas. Further, the surface oxides were removed with 20% diluted sulfuric acid after the heat treatment.

TABLE 1

| | | Chemical ingredient (mass %) | | | | | | | | |
|---|---|---|---|---|---|---|---|---|---|---|
| No. | Cu | Ni | Fe | P | Zn | Si | Mg | P/Si ratio | Ni/Fe ratio | (Ni + Fe)/P ratio |
| 1 | Balance | 0.25 | 0.04 | 0.05 | 0.1 | 0.004 | 0.0003 | 13 | 6.3 | 5.8 |
| 2 | Balance | 0.4 | 0.1 | 0.1 | 0.3 | 0.002 | 0.0005 | 50 | 4 | 5 |
| 3 | Balance | 0.45 | 0.11 | 0.08 | 0.05 | 0.003 | — | 27 | 4.1 | 7.0 |
| 4 | Balance | 0.6 | 0.1 | 0.13 | 0.1 | 0.005 | 0.0002 | 26 | 6 | 5.4 |
| 5 | Balance | 0.6 | 0.1 | 0.13 | 0.3 | 0.002 | 0.0003 | 65 | 6 | 5.4 |
| 6 | Balance | 0.6 | 0.15 | 0.15 | 0.3 | — | 0.0005 | ≧10 | 4 | 5 |
| 7 | Balance | 0.7 | 0.08 | 0.13 | 0.05 | 0.002 | 0.0005 | 65 | 8.8 | 6.0 |
| 8 | Balance | 0.7 | 0.15 | 0.15 | 0.1 | 0.002 | 0.0003 | 75 | 4.7 | 5.7 |

TABLE 1-continued

| No. | Cu | Ni | Fe | P | Zn | Si | Mg | P/Si ratio | Ni/Fe ratio | (Ni + Fe)/P ratio |
|---|---|---|---|---|---|---|---|---|---|---|
| | | Chemical ingredient (mass %) | | | | | | | | |
| 9 | Balance | 0.8 | 0.15 | 0.15 | 0.3 | 0.002 | 0.0003 | 75 | 5.3 | 6.3 |
| 10 | Balance | 0.05* | 0.1 | 0.03 | 0.05 | 0.002 | 0.0003 | 15 | 0.5 | 5 |
| 11 | Balance | 1.4* | 0.1 | 0.15 | 0.3 | 0.005 | 0.0005 | 30 | 14 | 10 |
| 12 | Balance | 0.6 | 0.002* | 0.1 | 0.1 | — | — | ≧10 | 300 | 6 |
| 13 | Balance | 0.6 | 0.6* | 0.2 | 0.3 | 0.007 | 0.0005 | 29 | 1 | 6 |
| 14 | Balance | 0.6 | 0.1 | 0.02* | 0.1 | 0.0015 | — | 13 | 6 | 70 |
| 15 | Balance | 0.6 | 0.1 | 0.3* | 0.3 | 0.003 | 0.0002 | 100 | 6 | 2.3 |
| 16 | Balance | 0.6 | 0.1 | 0.13 | 0.002* | 0.002 | 0.0003 | 65 | 6 | 5.4 |
| 17 | Balance | 0.6 | 0.1 | 0.13 | 0.8 | 0.005 | 0.0005 | 26 | 6 | 5.4 |
| 18 | Balance | 0.4 | 0.05 | 0.1 | 2.0* | 0.004 | 0.0002 | 11 | 8 | 5.6 |
| 19 | Balance | 0.6 | 0.1 | 0.13 | 0.1 | 0.02* | 0.0003 | 6.5* | 6 | 5.4 |
| 20 | Balance | 0.6 | 0.1 | 0.13 | 0.3 | 0.004 | 0.003* | 33 | 6 | 5.4 |

*Portion out of the definition of the invention
**Portion not satisfying the definition of Claim 2

TABLE 2

| No. | Compositional ratio of precipitates Ni | Fe | P | Internal oxide layer thickness (μm) | Characteristic: Tensile strength (N/mm²) | Electro-conductivity (% IACS) | Softening resistance (° C.) | Shearing formability: Sheared surface ratio (%) | Burr height 1) | W bending formability 2) | Heat resistant solder peeling | Soldering wettability 3) | Ag plating protrusion |
|---|---|---|---|---|---|---|---|---|---|---|---|---|---|
| 1 | 2.0 | 1.0 | 1 | ≦1 | 540 | 70 | 420 | 60 | C | No | No | B | No |
| 2 | 2.5 | 0.8 | 1 | ≦1 | 610 | 68 | 460 | 60 | C | No | No | A | No |
| 3 | 2.0 | 0.9 | 1 | ≦1 | 600 | 66 | 420 | 55 | C | No | No | C | No |
| 4 | 3.1 | 0.6 | 1 | ≦1 | 650 | 67 | 460 | 60 | B | No | No | A | No |
| 5 | 3.0 | 0.6 | 1 | ≦1 | 660 | 65 | 460 | 55 | C | No | No | A | No |
| 6 | 2.4 | 0.9 | 1 | ≦1 | 680 | 64 | 450 | 60 | B | No | No | B | No |
| 7 | 3.5 | 0.5 | 1 | ≦1 | 670 | 68 | 450 | 55 | B | No | No | A | No |
| 8 | 3.2 | 0.5 | 1 | ≦1 | 650 | 71 | 430 | 60 | B | No | No | A | No |
| 9 | 3.2 | 0.6 | 1 | ≦1 | 710 | 63 | 460 | 55 | B | No | No | C | No |

1) Evaluation rank for burr height:
A: <5 μm
B: ≧5 μm
C: ≧10 μm
D: ≧15 μm
E: ≧20 μm
2) W bending formability: presence or absence of cracking
3) Evaluation rank for soldering wettability
A: Entire surface wetting
B: Formation of pinhole
C: 95% wetting
D: 50% wetting
E: not wetting
*Portion for poor characteristic

TABLE 3

| No. | Compositional ratio of precipitates Ni | Fe | P | Internal oxide layer thickness (μm) | Characteristic: Tensile strength N/mm² | Electro-conductivity % IACS | Softening resistance (° C.) | Shearing formability: Sheared surface ratio (%) | Burr height 1) | W bending formability 2) | Heat resistant solder peeling | Soldering wettability 3) | Ag plating protrusion |
|---|---|---|---|---|---|---|---|---|---|---|---|---|---|
| 10 | 0.06* | 3.1* | 1 | ≦1 | 420* | 82 | 390* | 65* | D* | No | No | A | No |
| 11 | | | | | Edge cracking during hot rolling, no specimen could be formed* | | | | | | | | |
| 12 | | | | | Edge cracking during hot rolling, no specimen could be formed* | | | | | | | | |
| 13 | 2.4 | 2.8* | 1 | 7* | 490* | 78 | 370* | 70* | E* | No | No | E* | No |
| 14 | 3.4 | 0.7 | 1 | ≦1 | 500* | 42* | 350* | 60 | C | No | No | C | No |
| 15 | | | | | Edge cracking during hot rolling, no specimen could be formed* | | | | | | | | |
| 16 | 3.1 | 0.6 | 1 | ≦1 | 650 | 69 | 460 | 60 | C | No | Present* | B | No |
| 17 | 3.1 | 0.6 | 1 | ≦1 | 710 | 56* | 430 | 55 | B | No | No | D* | No |
| 18 | 3.7 | 0.4 | 1 | ≦1 | 620 | 49* | 410 | 55 | B | No | No | D* | No |

TABLE 3-continued

| | Compositional ratio of precipitates | | | Internal oxide layer thickness | Characteristic | | | | | | | | |
|---|---|---|---|---|---|---|---|---|---|---|---|---|---|
| | | | | | Tensile strength | Electro-conductivity | Softening resistance | Shearing formability: Sheared surface | Shearing formability: Burr height | W bending formability | Heat resistant solder peeling | Soldering wettability | Ag plating protrusion |
| No. | Ni | Fe | P | (μm) | N/mm² | % IACS | (° C.) | ratio (%) | 1) | 2) | | 3) | |
| 19 | 3.0 | 0.6 | 1 | 9* | 660 | 62 | 460 | 55 | B | Present* | Present* | E* | No |
| 20 | 3.1 | 0.6 | 1 | 4* | 670 | 65 | 460 | 55 | B | Present* | No | E* | Present* |

1) Evaluation rank for burr height:
A: <5 μm
B: ≧5 μm
C: ≧10 μm
D: ≧15 μm
E: ≧20 μm
2) W bending formability: presence or absence of cracking
3) Evaluation rank for soldering wettability:
A: Entire surface wetting
B: Formation of pinhole
C: 95% wetting
D: 50% wetting
E: not wetting
*Portion for poor characteristi Table 2 and Table 3 show the result of the test. As apparent from Table 2, Example Nos. 1 to 9 were excellent in strength, electroconductivity and softening resistance and were favorable in view of any of the characteristics such as shearing formability and bending formability.

On the contrary, as shown in Table 3, Comparative Example Nos. 10 to 20 could not prepare specimens or were deteriorated in any of the characteristics. No. 10 with less Ni content was poor in the strength and the shearing formability. No. 13 with high Fe content was poor in the strength, softening resistance and shearing formability and, in addition, was poor in the soldering wettability since the internal oxide layer was grown. No. 14 with less P content was poor in the strength, electroconductivity and softening resistance. No. 16 with less Zn content was poor in the heat resistant soldering peeling property. No. 19 with high Si content had an internal oxide layer of more increased thickness and was poor in the soldering wettability. No. 17 and No. 18 with high Zn content were low in the electroconductivity and also poor in the soldering wettability. No. 20 with high Mg content produced protrusions in Ag plating. Further, No. 11 with high Ni content, No. 12 with less Fe content and No. 15 with high P content could not prepare the material.

Example 2

Test specimens each of 0.25 mm thickness were prepared in the same steps as those in Example 1 using the copper alloys of the chemical compositions shown in Table 4 and the test described above was conducted.

TABLE 4

| | Chemical ingredient (mass %) | | | | | | | | | | |
|---|---|---|---|---|---|---|---|---|---|---|---|
| No. | Cu | Ni | Fe | P | Zn | Si | Mg | Co, Cr, Mn | Al, Sn, Zr, In, Ti, B, Ag, Be | O (ppm) | H (ppm) |
| 21 | Balance | 0.4 | 0.05 | 0.1 | 0.1 | 0.002 | 0.0002 | 0.01Cr | 0.03Sn | 11 | 1.6 |
| 22 | Balance | 0.4 | 0.05 | 0.1 | 0.1 | 0.002 | 0.0005 | 0.02Co, 0.01Cr | 0.005Al, 0.03Sn | 8 | 0.9 |
| 23 | Balance | 0.6 | 0.1 | 0.13 | 0.1 | 0.005 | — | 0.01Co | 0.01Al, 0.03Sn, 0.01Ag | 14 | 1.3 |
| 24 | Balance | 0.6 | 0.1 | 0.13 | 0.1 | — | 0.0003 | 0.005Cr, 0.04Mn | 0.005Al, 0.005Sn, 0.005In, 0.005Ti, 0.005Ag | 21 | 1.1 |
| 25 | Balance | 0.8 | 0.15 | 0.15 | 0.1 | 0.002 | — | 0.01Co, 0.01Cr, 0.01Mn | 0.01Sn, 0.01Be | 25 | 2.6 |
| 26 | Balance | 0.8 | 0.15 | 0.15 | 0.1 | 0.003 | 0.0002 | 0.01Mn | 0.005Ti, 0.002B | 10 | 1.5 |
| 27 | Balance | 0.4 | 0.05 | 0.1 | 0.1 | 0.004 | — | 0.002Co, 0.001 Mn** | 0.03Sn | 9 | 1.5 |
| 28 | Balance | 0.4 | 0.05 | 0.1 | 0.1 | — | 0.0005 | 0.04Co, 0.1Cr, 0.1Mn* | 0.01Sn | 15 | 0.8 |
| 29 | Balance | 0.6 | 0.1 | 0.13 | 0.1 | 0.002 | 0.0003 | 0.02Mn | 0.001Al, 0.002Sn** | 10 | 1.8 |
| 30 | Balance | 0.6 | 0.1 | 0.13 | 0.1 | 0.003 | 0.0002 | 0.03Co | 0.1Al, 0.1Sn* | 14 | 1.8 |
| 31 | Balance | 0.8 | 0.15 | 0.15 | 0.1 | — | 0.0002 | 0.01Cr, 0.02Mn | 0.005Al, 0.01Sn | 140* | 1.9 |
| 32 | Balance | 0.8 | 0.15 | 0.15 | 0.1 | 0.005 | 0.0004 | 0.01Co, 0.02Cr, 0.01Mn | 0.01Al, 0.005Sn, 0.005In, 0.005Ag | 10 | 12* |

*Portion out of the definition of the invention

**Portion less than the amount defined in the claims

TABLE 5

| No. | Internal oxide layer thickness (μm) | Tensile strength ($N/mm^2$) | Electro-conductivity (% IACS) | Softening resistance (° C.) | Shearing formability: Sheared surface ratio (%) | Shearing formability: Burr height 1) | W bending formability 2) | Soldering wettability 3) |
|---|---|---|---|---|---|---|---|---|
| 21 | ≦1 | 600 | 69 | 470 | 50 | B | No | B |
| 22 | ≦1 | 610 | 67 | 470 | 50 | B | No | B |
| 23 | ≦1 | 660 | 65 | 500 | 45 | B | No | A |
| 24 | ≦1 | 670 | 63 | 490 | 50 | A | No | A |
| 25 | ≦1 | 720 | 59 | 510 | 45 | A | No | C |
| 26 | ≦1 | 710 | 59 | 500 | 45 | A | No | C |
| 27 | ≦1 | 600 | 70 | 480 | 60** | C** | No | B |
| 28 | ≦1 | 590 | 60 | 480 | 50 | B | Present* | B |
| 29 | ≦1 | 650 | 67 | 460** | 50 | B | No | A |
| 30 | 4* | 670 | 52* | 480 | 45 | A | No | D* |
| 31 | 2* | 720 | 58 | 500 | 55** | B | No | D* |
| 32 | Cast ingot contain a lot of internal defects and no specimen could be prepared | | | | | | | |

*Portion of poor characteristic
**Portion equivalent with Nos. 1 to 12 of example 1
1) Evaluation rank for burr height
A: <5 μm
B: ≧5 μm
C: ≧10 μm
D: ≧15 μm
E: ≧20 μm
2) W bending formability: presence or absence of cracking
3) Evaluation rank for soldering wettability
A: Entire surface wetting
B: Formation of pinhole
C: 95% wetting
D: 50% wetting
E: not wetting Table 5 shows the result of the test. As can be seen from Table 5, examples for Nos. 21 to 26 were excellent in the strength, electroconductivity and softening resistance and were favorable in all of the characteristics such as shearing formability and bending formability. Compared with Nos. 1 to 9, the softening resistance and the shearing formability were improved entirely.

On the contrary, Nos. 27 to 32 of comparative examples could not prepare the specimens or any of the characteristics was poor or the characteristics were not improved. No. 27 with less content for the total of Co, Cr and Mn was less improved for the shearing formability compared with Example 1: No. 1 to 9, No. 29 with less total content for Al, Sn, Zr, In, Ti, B, Ag and Be showed no improvement for the softening resistance compared with Example 1: Nos. 1 to 19 respectively. Further, No. 28 with higher total content for Co, Cr and Mn was poor in the bending formability, and No. 30 with high total content for Al, Sn, Zr, In, Ti, B, Ag and Be was not only had low electroconductivity but also internal oxide layer formed therein and was poor in the soldering wettability. Further, No. 31 of high O content showed no improvement for the shearing formability, had internal oxide layer slightly formed therein and was poor in the soldering wettability. No. 32 with high H content could not prepare the specimen because of the internal defects of the cast ingot.

The copper alloy according to this invention has high strength and high electroconductivity, is excellent in the softening resistance and shearing formability and, further, excellent in the soldering wettability, heat resistant peeling property of solder and Sn plating, Ag plating property and bending formability by suppression of the internal oxidation. Further, the shearing formability and the softening resistance can be improved further by the addition of specified elements.

Since the copper alloy according to this invention is excellent in the softening resistance, the material per se is not softened even by the technique of removing the residual stress formed upon press punching, that is, by annealing applied in the course of the punching process. Further, the internal oxide layer can be suppressed in the course of annealing in the low oxygen atmosphere to provide a copper alloy excellent in surface characteristics (soldering wettability and heat resistant solder peeling property and Ag plating property). Further, the shearing formability is also favorable and it can cope with punching fabrication at high dimensional accuracy.

Further, since the formation of the internal oxide layer is suppressed, the copper alloy according to this invention is excellent in pickling property and, further, also excellent in the spring property and the stress moderating characteristic.

What is claimed is:

1. A copper alloy for use in electric and electronic parts, comprising:

0.45 to 1.0 mass % of Ni, 0.01 to 0.3 mass % of Fe, 0.03 to 0.2 mass % of P, 0.01 to 1.5 mass % of Zn, 0.01 mass % or less of Si; and 0.001 mass % or less of Mg, wherein the Ni content, the Fe content, the P content and the Si content satisfy the following relations simultaneously:

P content/Si content≧10,

5≦(Ni content+Fe content)/P content≦7 and

4≦Ni content/Fe content≦9.

2. The copper alloy for use in electric and electronic parts as defined in claim 1, said copper alloy containing precipitates under the following conditions:

$0.5 \leqq Ni/P \leqq 5$, and $0.1 \leqq Fe/P \leqq 2$, on a mass ratio basis.

3. The copper alloy for use in electric and electronic parts as defined in claim 1, further comprising at least one of elements of Co, Cr and Mn, wherein the total content of Co, Cr and Mn is from 0.005 to 0.05 mass %.

4. The copper alloy for use in electric and electronic parts as defined in claim 1, further comprising at least one elements of Al, Sn, Zr, In, Ti, B, Ag and Be, wherein the total content of Al, Sn, Zr, In, Ti, B, Ag and Be is from 0.005 to 0.05 mass %.

5. The copper alloy for use in electric and electronic parts as defined in claim 1, wherein O is contained by 100 ppm or less and H is contained by 10 ppm or less in the alloy.

6. The copper alloy as defined in claim 1, wherein the Ni content is from 0.45 to 0.7 mass %.

7. The copper alloy as defined in claim 1, wherein the Fe content is from 0.05–0.2 mass %.

8. The copper alloy as defined in claim 1, wherein the P content is from 0.06–0.15 mass %.

9. The copper alloy as defined in claim 1, wherein the Zn content is from 0.05–0.5 mass %.

10. The copper alloy as defined in claim 9, wherein the Zn content is from −0.05–0.2 mass %.

11. The copper alloy as defined in claim 1, wherein the Si content is 0.005 mass % or less.

12. The copper alloy as defined in claim 1, wherein the Mg content is 0.0005 mass % or less.

13. The copper alloy as defined in claim 1, wherein the P content/Si content is $\geqq 15$.

14. The copper alloy as defined in claim 1, wherein $5 \leqq$ (Ni content+Fe content)/P content $\leqq 6$ and $4 \leqq$ Ni content/Fe content $\leqq 8$.

15. The copper alloy as defined in claim 2, wherein $2 \leqq Ni/P \leqq 5$, and $0.5 \leqq Fe/P \leqq 1$, on the mass ratio basis.

16. The copper alloy as defined in claim 5, wherein the amount of O is 40 ppm or less.

17. The copper alloy as defined in claim 16, wherein the amount of O is 20 ppm or less.

18. The copper alloy as defined in claim 5, wherein the H content is 4 ppm or less.

19. The copper alloy as defined in claim 18, wherein the H content is 2 ppm or less.

* * * * *